US009583254B2

(12) United States Patent
Lim

(10) Patent No.: US 9,583,254 B2
(45) Date of Patent: Feb. 28, 2017

(54) MULTILAYER ELECTRONIC COMPONENT

(71) Applicant: SAMSUNG ELECTRO-MECHANICS CO., LTD., Suwon-Si, Gyeonggi-Do (KR)

(72) Inventor: Bong Sup Lim, Suwon-Si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 79 days.

(21) Appl. No.: 14/322,595

(22) Filed: Jul. 2, 2014

(65) Prior Publication Data

US 2015/0294779 A1 Oct. 15, 2015

(30) Foreign Application Priority Data

Apr. 11, 2014 (KR) ..... 10-2014-0043584

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 17/00*** | (2006.01) |

(52) U.S. Cl.

CPC ..... *H01F 27/292* (2013.01); *H01F 17/0013* (2013.01)

(58) Field of Classification Search

CPC ..... H01F 27/29
USPC ..... 336/200
See application file for complete search history.

(56) References Cited

U.S. PATENT DOCUMENTS

| | | | | |
|---|---|---|---|---|
| 6,107,907 | A * | 8/2000 | Leigh | H01F 17/0006 336/200 |
| 6,160,461 | A * | 12/2000 | Azuma | H03H 7/06 333/172 |
| 6,223,422 | B1 * | 5/2001 | Takeuchi | H01F 41/043 29/602.1 |
| 2008/0254968 | A1 * | 10/2008 | Kakuda | C04B 35/465 501/137 |

FOREIGN PATENT DOCUMENTS

| | | | |
|---|---|---|---|
| JP | 2001-358016 | A | 12/2001 |
| KR | 10-2012-0049617 | A | 5/2012 |
| KR | 10-2012-0055253 | A | 5/2012 |

* cited by examiner

*Primary Examiner* — Elvin G Enad
*Assistant Examiner* — Ronald Hinson
(74) *Attorney, Agent, or Firm* — McDermott Will & Emery LLP

(57) ABSTRACT

A multilayer electronic component includes a ceramic body including a plurality of insulating layers; an internal coil part in which a plurality of first internal coil patterns and a plurality of second internal coil patterns disposed on the insulating layers are connected to each other; and a first external electrode connected to first lead parts of the first and second internal coil patterns, and a second external electrode connected to second lead parts of the first and second internal coil patterns, wherein the first and second internal coil patterns are disposed on the insulating layers adjacent to each other and are connected to each other in parallel, and the via electrodes are disposed such that a plurality of via electrodes configure a single connection terminal.

20 Claims, 5 Drawing Sheets

MULTILAYER ELECTRONIC COMPONENT

CROSS-REFERENCE TO RELATED APPLICATION

This application claims the benefit of Korean Patent Application No. 10-2014-0043584 filed on Apr. 11, 2014, with the Korean Intellectual Property Office, the disclosure of which is incorporated herein by reference.

BACKGROUND

The present disclosure relates to a multilayer electronic component.

In a multilayer inductor, in a case in which the number of turns of an internal coil part is increased in order to implement a high inductance, a direct current (DC) resistance may be increased, such that a quality factor Q may be decreased.

Therefore, in order to decrease the DC resistance of the multilayer inductor, a parallel structure in which layers of internal coil patterns connected to external electrodes are connected in parallel with each other and the internal coil patterns having the common shapes are repeatedly formed in double layers, is used.

However, in a case in which the parallel structure as described above is used, via connections between layers may be inevitably increased.

Therefore, in accordance with the increase in the via connections in the multilayer inductor having the parallel structure, a quality factor Q may be decreased due to a resistance increase in a via connection portion. In a case in which the via connections are weak, an open defect may be caused.

RELATED ART DOCUMENT (Patent Document 1) Japanese Patent Laid-Open Publication No. 2001-358016

SUMMARY

An aspect of the present disclosure may provide a multilayer electronic component having a parallel structure capable of improving weakness of via connections and having an improved quality factor Q.

According to an aspect of the present disclosure, a multilayer electronic component may include: a ceramic body including a plurality of insulating layers; an internal coil part in which a plurality of first internal coil patterns and a plurality of second internal coil patterns disposed on the plurality of insulating layers are connected to each other by via electrodes penetrating through the insulating layers; and a first external electrode disposed on at least one surface of the ceramic body and connected to first lead parts of the first and second internal coil patterns, and a second external electrode disposed on at least one surface of the ceramic body and connected to second lead parts of the first and second internal coil patterns, wherein the internal coil part is formed by stacking a plurality of double internal coil patterns disposed on the insulating layers adjacent to each other and having shapes corresponding to each other, and the respective internal coil patterns disposed on the adjacent insulating layers are connected to each other by a connection terminal including a plurality of via electrodes penetrating through the insulating layers.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
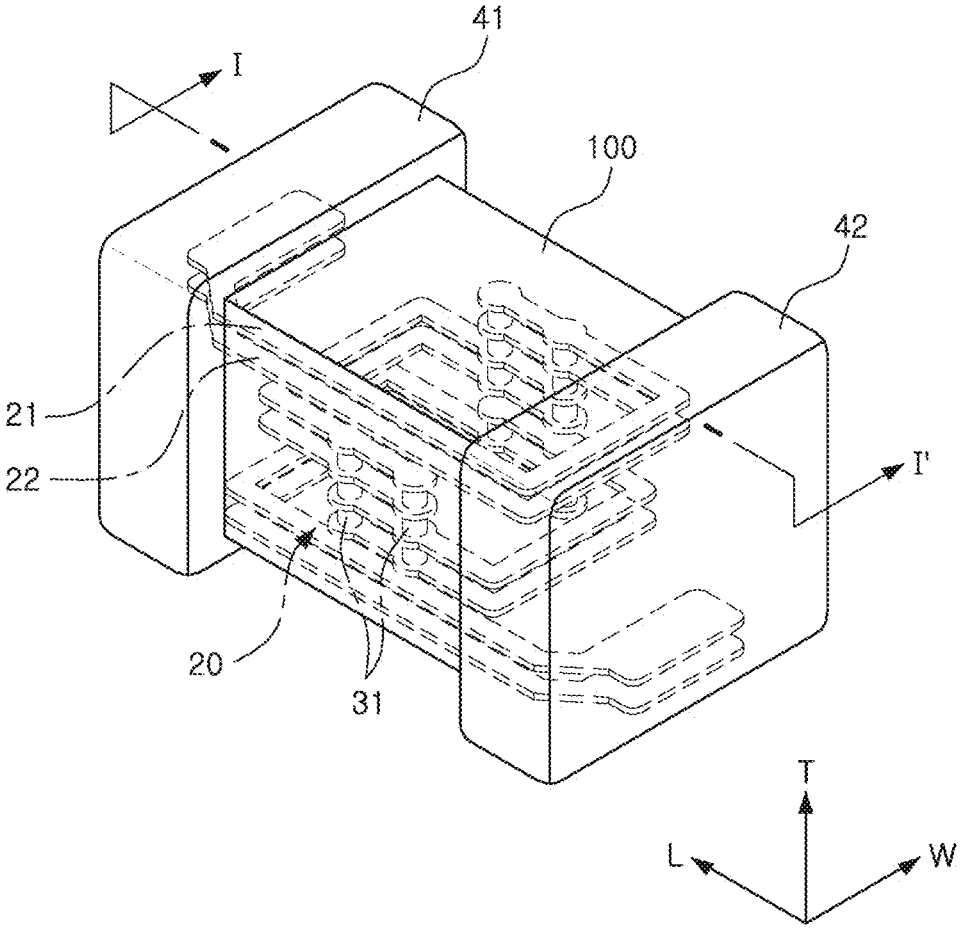
FIG. 1 is a schematic perspective view showing a multilayer electronic component according to an exemplary embodiment of the present disclosure so that an internal coil part of the multilayer electronic component is viewed.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Multilayer Electronic Component

Hereinafter, a multilayer electronic component according to an exemplary embodiment of the present disclosure, particularly, a multilayer inductor will be described by way of example. However, the present disclosure is not limited thereto.

FIG. 1 is a schematic perspective view showing a multilayer electronic component according to an exemplary embodiment of the present disclosure so that an internal coil part of the multilayer electronic component is viewed.

Referring to FIG. 1, a multilayer electronic component according to an exemplary embodiment of the present disclosure may include a ceramic body 100, an internal coil part 20 disposed in the ceramic body 100 and having a parallel structure, and first and second external electrodes 41 and 42 disposed on both end surfaces of the ceramic body 100 in a length direction thereof, respectively.

The ceramic body 100 may be in a state in which a plurality of insulating layers are sintered, and adjacent insulating layers may be integrated with each other so that boundaries therebetween are not readily apparent without a scanning electron microscope (SEM).

The ceramic body 100 may have a hexahedral shape. Directions of a hexahedron will be defined in order to clearly describe an exemplary embodiment of the present disclosure. L, W and T shown in FIG. 1 refer to a length direction, a width direction, and a thickness direction, respectively.

The insulating layer may contain a ferrite material known in the art such as Mn—Zn based ferrite, Ni—Zn based ferrite, Ni—Zn—Cu based ferrite, Mn—Mg based ferrite, Ba based ferrite, Li based ferrite, or the like.

The internal coil part 20 disposed in the ceramic body 100 and having the parallel structure may be formed by connecting a plurality of internal coil patterns 21 and 22 disposed on a plurality of insulating layers to each other by connection terminals 31 penetrating through the insulating layers.

The internal coil patterns 21 and 22 may be formed by printing a conductive paste containing a conductive metal. A material for the conductive metal is not particularly limited, as long as the material may have excellent electrical conductivity. For example, the conductive metal may be silver (Ag), palladium (Pd), aluminum (Al), nickel (Ni), titanium (Ti), gold (Au), copper (Cu), or platinum (Pt), or a mixture thereof.

Figure 2:
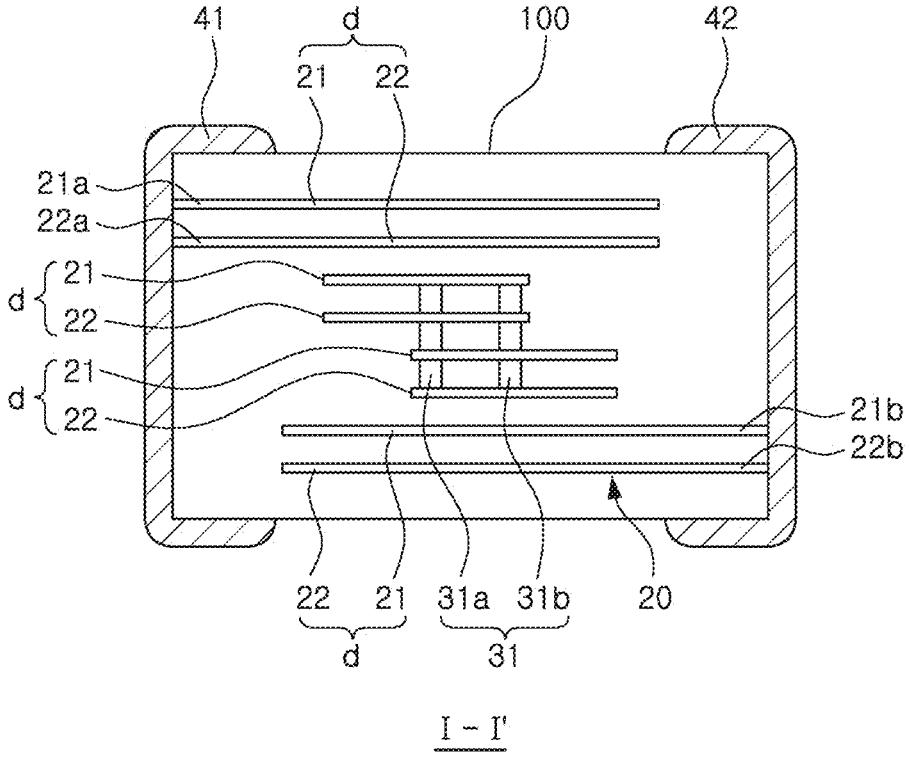
FIG. 2 is a cross-sectional view taken along line I-I' of FIG. 1.

FIG. 2 is a cross-sectional view taken along line I-I' of FIG. 1.

Referring to FIG. 2, a first internal coil pattern 21 and a second internal coil pattern 22 disposed on the insulating layers adjacent to each other may configure a single double internal coil pattern d, and a plurality of double internal coil patterns d may be stacked to thereby form the internal coil part 20.

At least one first internal coil pattern 21 of the plurality of first internal coil patterns 21 may have a first lead part 21*a* exposed to one end surface of the ceramic body 100, and at least one second internal coil pattern 22 of the plurality of second internal coil patterns 22 may have a first lead part 22*a* exposed to one end surface of the ceramic body 100.

The first lead parts 21*a* and 22*a* of the first and second internal coil patterns 21 and 22 may be connected to the first external electrode 41 in parallel.

In addition, at least one first internal coil pattern 21 of the plurality of first internal coil patterns 21 may have a second lead part 21*b* exposed to the other end surface of the ceramic body 100, and at least one second internal coil pattern 22 of the plurality of second internal coil patterns 22 may have a second lead part 22*b* exposed to the other end surface of the ceramic body 100.

The second lead parts 21*b* and 22*b* of the first and second internal coil patterns 21 and 22 may be connected to the second external electrode 42 in parallel.

The first and second external electrodes 41 and 42 may be formed of a metal having excellent electrical conductivity, for example, nickel (Ni), copper (Cu), tin (Sn), or silver (Ag) or an alloy thereof.

The internal coil patterns disposed on the insulating layers adjacent to each other may be connected to each other by at least one connection terminal 31 to form the internal coil part 20 having a coil structure.

The connection terminal 31 may include a plurality of via electrodes 31*a* and 31*b*.

Although FIG. 2 illustrates the connection terminal 31 including two via electrodes 31*a* and 31*b*, the present disclosure is not limited thereto. For example, the connection terminal 31 may include two or three via electrodes.

The internal coil patterns 21 and 22 disposed on the adjacent insulating layers are connected to each other by the connection terminal 31 including the plurality of via electrodes 31*a* and 31*b*. Thus, even in a case in which via connections formed by a portion of the plurality of via electrodes are weak, when a via connection is only formed by a single via electrode in a single connection terminal, an open defect may be prevented.

Figure 3:
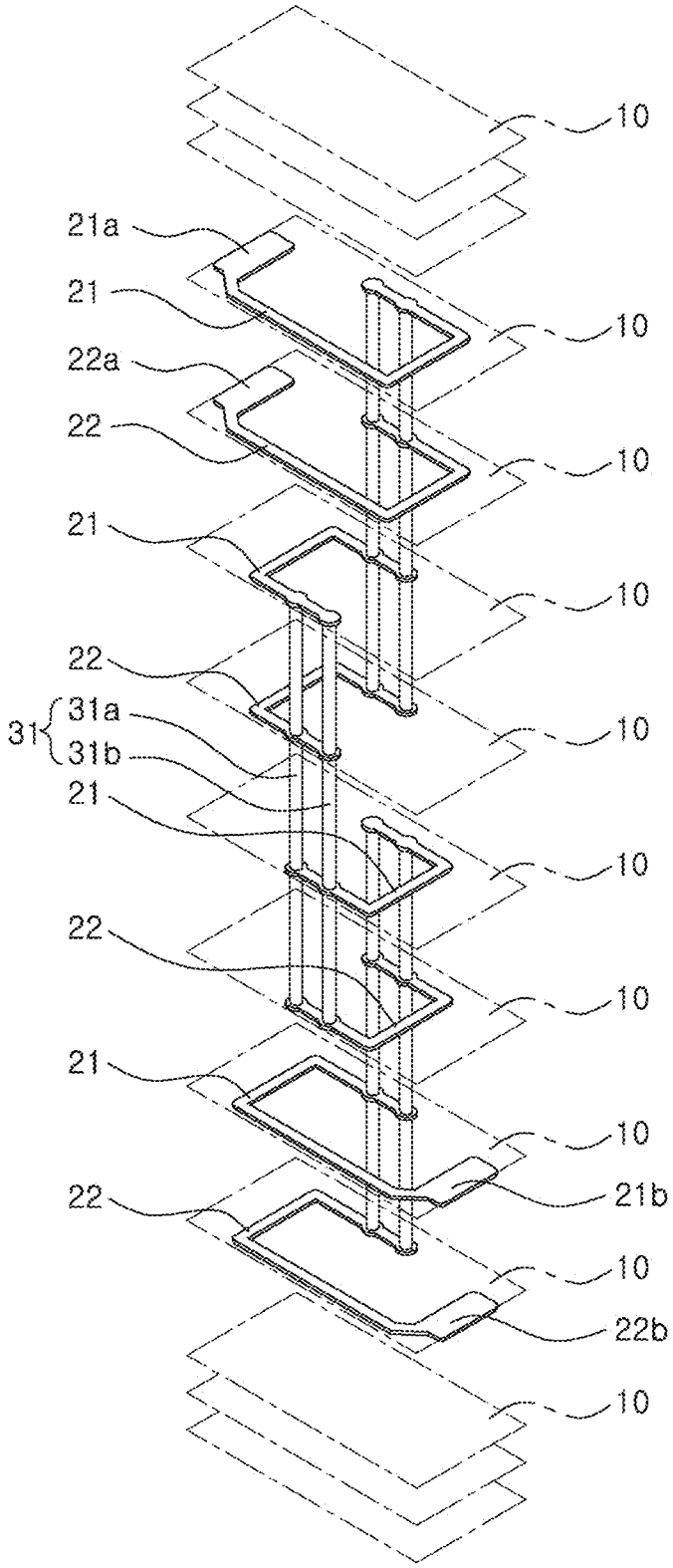
FIG. 3 is an exploded perspective view of a ceramic body of the multilayer electronic component according to an exemplary embodiment of the present disclosure.

FIG. 3 is an exploded perspective view of a ceramic body of the multilayer electronic component according to an exemplary embodiment of the present disclosure.

Referring to FIG. 3, the plurality of double internal coil patterns d each including the first and second internal coil patterns 21 and 22 disposed in n−1-th and n-th positions (n indicates a multiple of 2), respectively, based on an uppermost internal coil pattern among the internal coil patterns configuring the internal coil part 20 may be stacked.

The first and second internal coil patterns 21 and 22 configuring a single double internal coil pattern d may have shapes corresponding to each other, that is, common shapes.

The common shapes may be shapes in which turn amounts (for example, ½ turn or ¾ turn) and turn directions of internal coil patterns are the same as each other as well as shapes completely coinciding with each other.

The first and second internal coil patterns 21 and 22 configuring a double internal coil pattern d disposed in the uppermost portion among the plurality of double internal coil patterns d may have the first lead parts 21*a* and 22*a*, respectively, and the first lead parts 21*a* and 22*a* may be connected to the first external electrode 41, such that the first and second internal coil patterns 21 and 22 may be connected to each other in parallel.

In addition, the first and second internal coil patterns 21 and 22 configuring a double internal coil pattern d disposed in the lowermost portion among the plurality of double internal coil patterns d may have the second lead parts 21*b* and 22*b*, respectively, and the second lead parts 21*b* and 22*b* may be connected to the second external electrode 42, such that the first and second internal coil patterns 21 and 22 may be connected to each other in parallel.

The first and second internal coil patterns 21 and 22 that are not connected to the first and second external electrodes 41 and 42 and are disposed at n−1-th and n-th positions (n indicates a multiple of 2), respectively, may be connected to each other in parallel by a plurality of the connection terminals 31.

That is, the plurality of double internal coil patterns d may be stacked, and the first and second internal coil patterns 21 and 22 configuring the double internal coil patterns d may be connected to each other in parallel to thereby form the internal coil part 20 having the parallel structure.

The internal coil patterns disposed on the insulating layers 10 adjacent to each other may be connected to each other by the connection terminal 31, and the connection terminal 31 may include the plurality of via electrodes 31*a* and 31*b*.

The via electrodes 31*a* and 31*b* may be formed by forming holes in portions of the insulating layer 10 and filling the holes with a conductive metal, for example, silver (Ag), palladium (Pd), aluminum (Al), nickel (Ni), titanium (Ti), gold (Au), copper (Cu), or platinum (Pt), or a mixture thereof.

Since a single connection terminal 31 includes two or more via electrodes, even in a case in which via connections formed by a portion of the plurality of via electrodes are weak, when a via connection is only formed by a single via electrode in a single connection terminal, an open defect may be prevented.

In addition, the multilayer electronic component may have a structure in which internal coil patterns are additionally connected to each other in parallel in a structure of a single double internal coil pattern d in which the internal coil patterns are connected to each other in parallel. Therefore, an inductance may be increased, a resistance may be decreased, and a quality factor Q may be increased.

The internal coil part 20 may be disposed to be closer to an upper surface $S_T$ of the ceramic body 100 in a thickness direction thereof, as compared to a lower surface $S_B$ of the ceramic body 100 in the thickness direction thereof (not shown).

Therefore, an inductance and a quality factor Q may be increased.

Figure 4A:
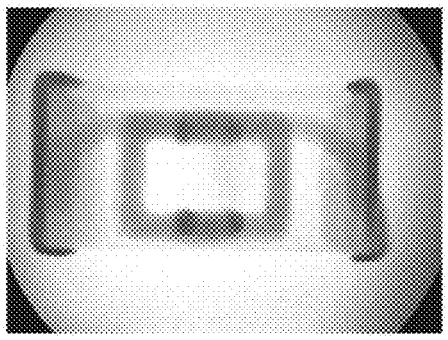
FIGS. 4A and 4B are non-destructive testing (NDT) analysis images of the multilayer electronic component according to an exemplary embodiment of the present disclosure.
Figure 4B:
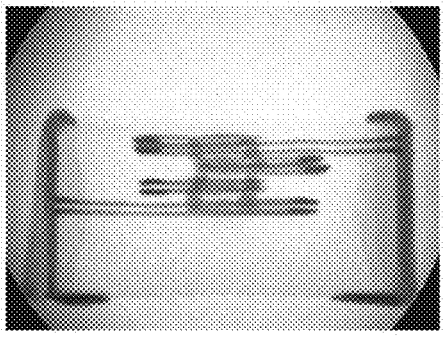

FIGS. 4A and 4B are non-destructive testing (NDT) analysis images of the multilayer electronic component according to an exemplary embodiment of the present disclosure.

FIG. 4A is an image of the multilayer electronic component according to an exemplary embodiment of the present disclosure, when viewed from above. The connection terminal including two via electrodes (denoted by a darker color as compared to a surrounding color) may be determined in FIG. 4A.

Due to the connection terminal, weakness of via connection may be improved, and a quality factor Q may be increased.

FIG. 4B is an image of the multilayer electronic component according to an exemplary embodiment of the present disclosure, when viewed in an L-T direction. The structure of the double internal coil pattern d and the connection terminal having two via electrodes may be determined in FIG. 4B.

In addition, the internal coil part is formed to be adjacent to the upper surface of the ceramic body in the thickness direction thereof. Therefore, a decrease in an inductance or a quality factor Q due to an eddy current may be prevented.

Figure 5:
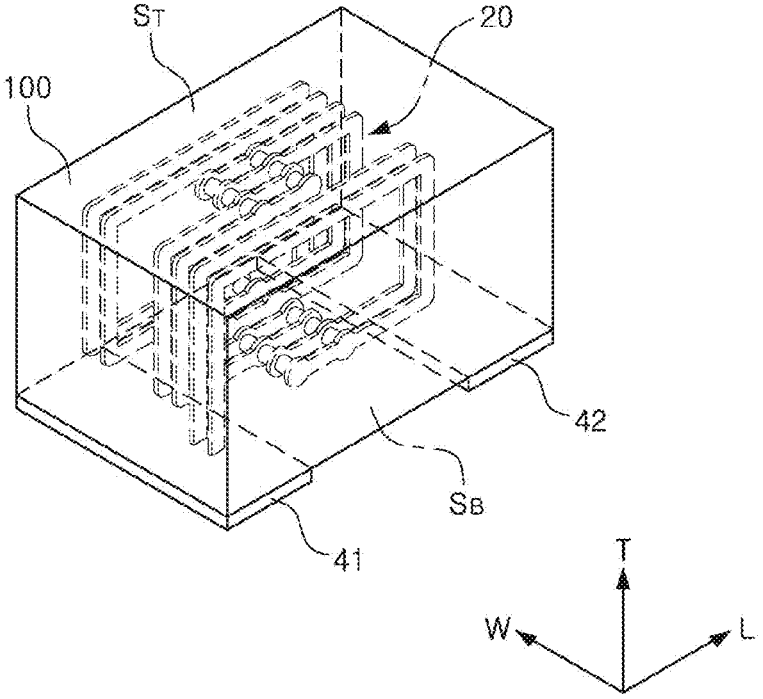
FIG. 5 is a schematic perspective view showing a multilayer electronic component according to another exemplary embodiment of the present disclosure so that an internal coil part of the multilayer electronic component is viewed.

FIG. 5 is a schematic perspective view showing a multilayer electronic component according to another exemplary embodiment of the present disclosure so that an internal coil part of the multilayer electronic component is viewed.

Referring to FIG. 5, a central axis of the internal coil part 20 penetrating through the center of the internal coil part 20 disposed in the ceramic body 100 may be disposed to be parallel to the upper surface $S_T$ or the lower surface $S_B$ of the ceramic body 100 in the thickness direction thereof.

That is, the first and second internal coil patterns 21 and 22 forming the internal coil part 20 may be disposed to be perpendicular to the upper surface $S_T$ or the lower surface $S_B$ of the ceramic body 100 in the thickness direction thereof.

The first lead parts 21*a* and 22*a* and second lead parts 21*b* and 22*b* of the first and second internal coil patterns 21 and 22 may be exposed to the lower surface $S_B$ of the ceramic body 100 in the thickness direction thereof.

The first and second external electrodes 41 and 42 may be disposed on the lower surface $S_B$ of the ceramic body 100 in the thickness direction thereof, and the first lead parts 21*a* and 22*a* may be connected to the first external electrode 41 and the second lead parts 21*b* and 22*b* may be connected to the second external electrode 42, such that the first and second internal coil patterns 21 and 22 may be connected to each other in parallel.

Figure 6:
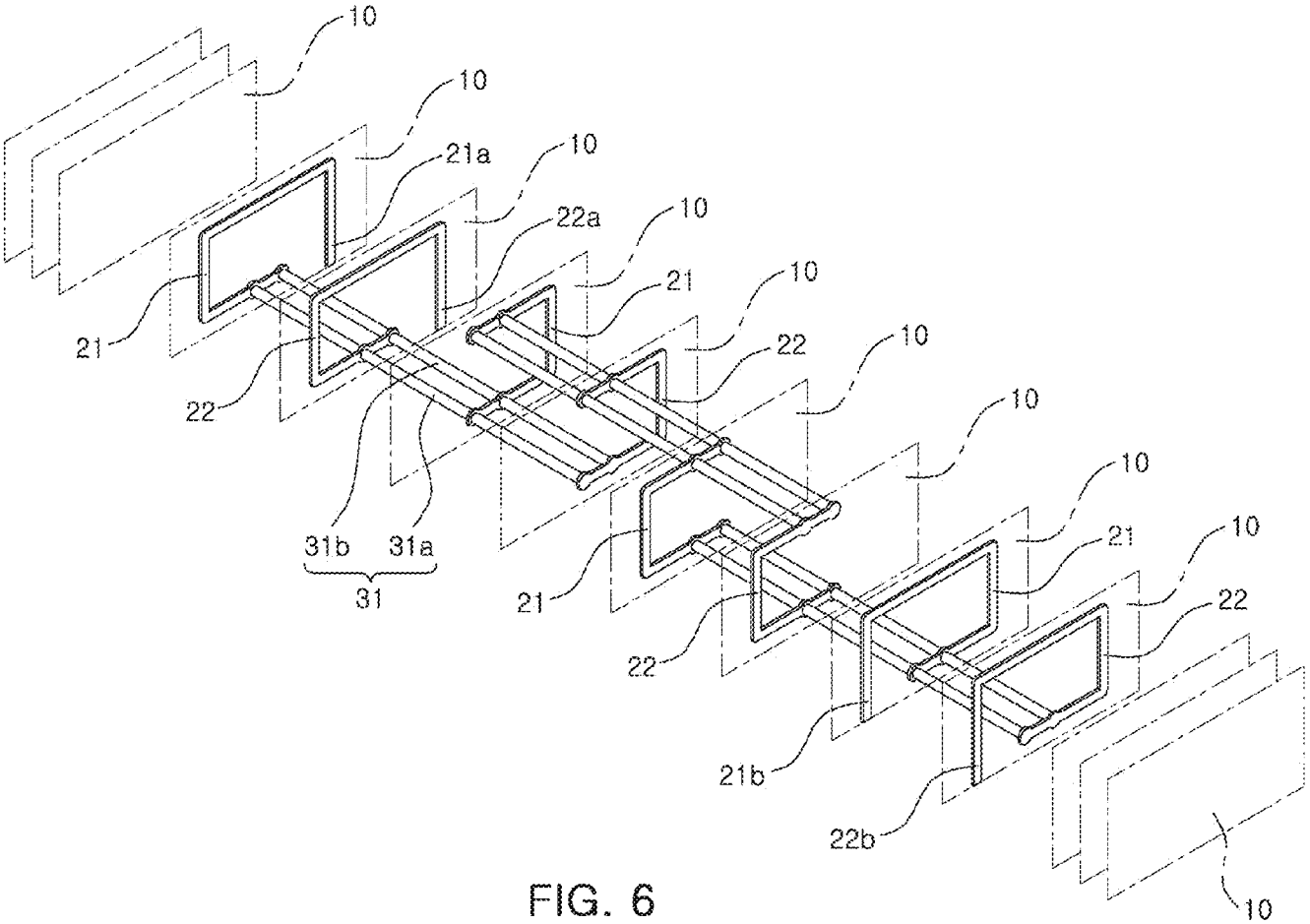
FIG. 6 is an exploded perspective view of a ceramic body of the multilayer electronic component according to another exemplary embodiment of the present disclosure.

FIG. 6 is an exploded perspective view of a ceramic body of the multilayer electronic component according to another exemplary embodiment of the present disclosure.

Referring to FIG. 6, a plurality of double internal coil patterns d each including first and second internal coil patterns 21 and 22 disposed in n−1-th and n-th positions (n indicates a multiple of 2), respectively, based on an outermost internal coil pattern among internal coil patterns configuring the internal coil part 20 may be stacked.

The first and second internal coil patterns 21 and 22 configuring a single double internal coil pattern d may have shapes corresponding to each other, that is, common shapes. The common shapes may be shapes in which turn amounts (for example, ½ turn or ¾ turn) and turn directions of internal coil patterns are the same as each other as well as shapes completely coinciding with each other.

The first and second internal coil patterns 21 and 22 configuring a double internal coil pattern d positioned at one outermost portion among the plurality of double internal coil patterns d may have the first lead parts 21*a* and 22*a*, respectively, and first and second internal coil patterns 21 and 22 configuring a double internal coil pattern d positioned at the remaining outermost portion among the plurality of double internal coil patterns d may have second lead parts 21*b* and 22*b*, respectively.

The first lead parts 21*a* and 22*a* may be connected to the first external electrode 41 and the second lead parts 21*b* and 22*b* may be connected to the second external electrode 42, such that the first and second internal coil patterns 21 and 22 may be connected to each other in parallel.

The first and second internal coil patterns 21 and 22 that are not connected to the first and second external electrodes 41 and 42 and are disposed in n−1-th and n-th positions (n indicates a multiple of 2), respectively, may be connected to each other by the plurality of connection terminals 31.

That is, the plurality of double internal coil patterns d may be stacked, and the first and second internal coil patterns 21 and 22 configuring the double internal coil patterns d may be connected to each other in parallel to thereby form the internal coil part 20 having the parallel structure.

The internal coil patterns disposed on the adjacent insulating layers 10 may be connected to each other by the connection terminal 31, and the connection terminal 31 may include the plurality of via electrodes 31*a* and 31*b*.

Since a single connection terminal 31 includes two or more via electrodes, even in a case in which via connections formed by a portion of the plurality of via electrodes are weak, when a via connection is only formed by a single via electrode in a single connection terminal, an open defect may be prevented.

In addition, the multilayer electronic component may have a structure in which internal coil patterns are additionally connected to each other in parallel in a structure of a single double internal coil pattern d in which the internal coil patterns are connected to each other in parallel. Therefore, an inductance may be increased, a resistance may be decreased, and a quality factor Q may be increased.

As set forth above, in a multilayer electronic component according to exemplary embodiments of the present disclosure, weakness of via connections may be improved, and a quality factor Q may be increased.

While exemplary embodiments have been shown and described above, it will be apparent to those skilled in the art that modifications and variations could be made without departing from the spirit and scope of the present disclosure as defined by the appended claims.

What is claimed is:

1. A multilayer electronic component comprising:

a ceramic body including a plurality of insulating layers;

an internal coil part in which a plurality of first internal coil patterns and a plurality of second internal coil patterns disposed on the plurality of insulating layers are connected to each other by via electrodes penetrating through the insulating layers; and a first external electrode disposed on at least one surface of the ceramic body and connected to first lead parts of the first and second internal coil patterns, and a second external electrode disposed on at least one surface of the ceramic body and connected to second lead parts of the first and second internal coil patterns, wherein the first and second internal coil patterns are disposed on the insulating layers adjacent to each other, the first and second internal coil patterns are connected to each other in parallel, the via electrodes are disposed such that a plurality of the via electrodes configure a single connection terminal, at least one pair of the first and second internal coil patterns adjacent to each other are connected by four or more of the via electrodes, and two of the four or more via electrodes connect with and overlap two of the via electrodes which are located thereabove.

2. The multilayer electronic component of claim 1, wherein the internal coil part includes the first and second internal coil patterns disposed in n−1-th and n-th positions (n indicates a multiple of 2), respectively, based on an uppermost internal coil pattern among the internal coil patterns.

3. The multilayer electronic component of claim 2, wherein the first and second internal coil patterns disposed in the n−1-th and n-th positions, respectively, have shapes corresponding to each other.

4. The multilayer electronic component of claim 1, wherein the connection terminal includes two or three via electrodes.

5. The multilayer electronic component of claim 1, wherein the first and second internal coil patterns that are not connected to the first and second external electrodes are connected to each other in parallel by a plurality of connection terminals.

6. The multilayer electronic component of claim 1, wherein the internal coil part is disposed to be closer to an upper surface of the ceramic body in a thickness direction thereof, as compared to a lower surface of the ceramic body in the thickness direction thereof.

7. The multilayer electronic component of claim 1, wherein the first and second internal coil patterns are disposed to be perpendicular to an upper surface or a lower surface of the ceramic body in a thickness direction thereof.

8. The multilayer electronic component of claim 7, wherein the first and second lead parts of the first and second internal coil patterns are exposed to the lower surface of the ceramic body in the thickness direction thereof, and the first and second external electrodes are disposed on the lower surface of the ceramic body in the thickness direction thereof.

9. A multilayer electronic component comprising:

a ceramic body including a plurality of insulating layers;

an internal coil part disposed in the ceramic body; and a first external electrode disposed on at least one surface of the ceramic body and connected to a first lead part of the internal coil part and a second external electrode disposed on at least one surface of the ceramic body and connected to a second lead part of the internal coil part, wherein the internal coil part is formed by stacking a plurality of double internal coil patterns disposed on the insulating layers adjacent to each other and having shapes corresponding to each other, the respective internal coil patterns disposed on the adjacent insulating layers are connected to each other by a connection terminal including a plurality of via electrodes penetrating through the insulating layers, at least one pair of the internal coil patterns adjacent to each other are connected by four or more of the via electrodes, and two of the four or more via electrodes connect with and overlap two of the via electrodes which are located thereabove.

10. The multilayer electronic component of claim 9, wherein the double internal coil patterns include first and second internal coil patterns disposed in n−1-th and n-th positions (n indicates a multiple of 2), respectively, based on an uppermost internal coil pattern of the internal coil part.

11. The multilayer electronic component of claim 10, wherein each of the first and second internal coil patterns has the first lead part to be connected to the first external electrode, while each of the first and second internal coil patterns has the second lead part to be connected to the second external electrode.

12. The multilayer electronic component of claim 10, wherein first and second internal coil patterns that are not connected to the first and second external electrodes and are disposed in the n−1-th and n-th positions (n indicates a multiple of 2), respectively, among the first and second internal coil patterns are connected to each other in parallel by a plurality of connection terminals.

13. The multilayer electronic component of claim 9, wherein the connection terminal includes two or three via electrodes.

14. The multilayer electronic component of claim 9, wherein a central axis of the internal coil part is disposed to be parallel to an upper surface or a lower surface of the ceramic body in a thickness direction thereof.

15. The multilayer electronic component of claim 14, wherein the first and second lead parts of the internal coil part are exposed to the lower surface of the ceramic body in the thickness direction thereof, and the first and second external electrodes are disposed on the lower surface of the ceramic body in the thickness direction thereof.

16. A multilayer electronic component comprising:

a ceramic body including a plurality of insulating layers;

a plurality of internal coil patterns disposed on the plurality of insulating layers; and a connection terminal connecting internal coil patterns disposed on the insulating layers adjacent to each other, among the internal coil pattern, to form an internal coil part, wherein first and second internal coil patterns disposed in n−1-th and n-th positions (n indicates a multiple of 2), respectively, based on an uppermost internal coil pattern among the plurality of internal coil patterns, have shapes corresponding to each other and are connected to each other in parallel, the connection terminal includes a plurality of via electrodes penetrating through the insulating layers, at least one pair of the first and second internal coil patterns adjacent to each other are connected by four or more of the via electrodes, and two of the four or more via electrodes connect with and overlap two of the via electrodes which are located thereabove.

17. The multilayer electronic component of claim 16, further comprising a first external electrode disposed on at least one surface of the ceramic body and connected to first lead parts of the first and second internal coil patterns, and a second external electrode disposed on at least one surface of the ceramic body and connected to second lead parts of the first and second internal coil patterns.

18. The multilayer electronic component of claim 16, wherein the first and second internal coil patterns are disposed to be perpendicular to an upper surface or a lower surface of the ceramic body in a thickness direction thereof.

19. The multilayer electronic component of claim 18, wherein the first and second lead parts of the first and second internal coil patterns are exposed to the lower surface of the ceramic body in the thickness direction thereof, and a first external electrode connected to first lead parts of the first and second internal coil patterns and a second external electrode connected to second lead parts of the first and second internal coil patterns are disposed on the lower surface of the ceramic body in the thickness direction thereof.

20. The multilayer electronic component of claim 1, wherein the other two of the four or more via electrodes connect and overlap two of the via electrodes which are located therebelow.

* * * * *